US006270936B1

(12) United States Patent
Tanaka et al.

(10) Patent No.: US 6,270,936 B1
(45) Date of Patent: Aug. 7, 2001

(54) ELECTROPHOTOGRAPHIC PHOTOSENSITIVE MEMBER, PROCESS CARTRIDGE, AND ELECTROPHOTOGRAPHIC APPARATUS

(75) Inventors: Masato Tanaka, Shizuoka-ken; Kouichi Nakata, Numazu, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/379,920

(22) Filed: Aug. 24, 1999

(30) Foreign Application Priority Data

Aug. 25, 1998 (JP) ..... 10-253344

(51) Int. Cl.[7] ..... G03G 15/02
(52) U.S. Cl. ..... 430/59.5; 430/59.4; 430/78
(58) Field of Search ..... 430/59.4, 59.5, 430/78

(56) References Cited

U.S. PATENT DOCUMENTS

| | | | | |
|---|---|---|---|---|
| 4,981,767 | * | 1/1991 | Tokura et al. | 430/59.4 |
| 5,102,758 | * | 4/1992 | Kazmaier et al. | 430/59.5 |
| 5,213,929 | * | 5/1993 | Takano et al. | 430/59.5 |
| 5,578,406 | | 11/1996 | Ojima et al. | 430/83 |
| 5,595,846 | * | 1/1997 | Shigematsu et al. | 430/78 |
| 5,725,985 | | 3/1998 | Nealy et al. | 430/96 |

FOREIGN PATENT DOCUMENTS

| | | |
|---|---|---|
| 0638848 | 2/1995 | (EP) . |
| 0803546 | 10/1997 | (EP) . |
| 61-217050 | 9/1986 | (JP) . |
| 61-239248 | 10/1986 | (JP) . |
| 01-017066 | 1/1989 | (JP) . |
| 03-037666 | 2/1991 | (JP) . |
| 03-128973 | 5/1991 | (JP) . |
| 05-066596 | 3/1993 | (JP) . |
| 05-263007 | 10/1993 | (JP) . |
| 06-093203 | 4/1994 | (JP) . |
| 07-128888 | 5/1995 | (JP) . |

* cited by examiner

*Primary Examiner*—Mark Chapman
(74) *Attorney, Agent, or Firm*—Fitzpatrick, Cella, Harper & Scinto

(57) ABSTRACT

An electrophotographic photosensitive member comprising a support and a photosensitive layer. The photosensitive layer contains an oxytitanium phthalocyanine having the strongest peak at 27.2°±0.2° of the diffraction angle (2θ) in CuKα characteristic X-ray diffraction and a hydroxygallium phthalocyanine having strong peaks at 7.4°±0.2° and 28.2°±0.2° of the diffraction angle (2θ) in CuKα characteristic X-ray diffraction. A process cartridge and an electrophotographic apparatus, employing the electrophotographic photosensitive member, are also disclosed.

6 Claims, 4 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

This invention relates to an electrophotographic photosensitive member, and more particularly to an electrophotographic photosensitive member having a photosensitive layer containing a specific compound as a charge-generating material. This invention also relates to a process cartridge and an electrophotographic apparatus which have such electrophotographic photosensitive member.

2. Related Background Art

Phthalocyanine pigments are not only used for coloring, but also have long attracted notice and have been studied as electronic materials used in electrophotographic photosensitive members, solar cells, sensors and so forth.

In recent years, printers to which electrophotography is applied are also in wide use as terminal unit printers. These are chiefly laser beam printers having lasers as light sources. As the light sources, semiconductor lasers are used in view of the cost, the size of apparatus and so forth. Semiconductor lasers prevailingly used at present have an oscillation wavelength of as long as 790 to 820 nm. Accordingly, electrophotographic photosensitive members having sufficient sensitivities in such a long-wavelength region are being developed.

Sensitivity regions of electrophotographic photosensitive members differ depending on the types of charge-generating materials. In recent years, as charge-generating materials having a sensitivity to long-wavelength light, substantial research has been conducted on metal phthalocyanines or metal-free phthalocyanines such as aluminum chlorophthalocyanine, chloroindium phthalocyanine, oxyvanadium phthalocyanine, hydroxygallium phthalocyanine, chlorogallium phthalocyanine, magnesium phthalocyanine and oxytitanium phthalocyanine.

Of these phthalocyanines, oxytitanium phthalocyanine is disclosed in Japanese Patent Application Laid-open Nos. 61-217050, 61-239248, 64-17066 and 3-128973. Hydroxygallium phthalocyanine is disclosed in Japanese Patent Application Laid-open Nos. 5-263007 and 6-93203.

As a combination of charge-generating materials, Japanese Patent Application Laid-open Nos. 3-37666, 5-66596 and 7-128888 disclose an electrophotographic photosensitive member having a broad sensitivity wavelength region (i.e., panchromatic), using a phthalocyanine compound and an azo pigment in combination.

An electrophotographic photosensitive member making use of an oxytitanium phthalocyanine having the strongest peak at 27.2°±0.2° of the diffraction angle (2θ) in CuKα characteristic X-ray diffraction has a very high sensitivity and also a good charging performance, but those having much superior characteristics with respect to residual potential, photomemory and potential stability are under study. Also, an electrophotographic photosensitive member making use of a hydroxygallium phthalocyanine having strong peaks at 7.4°±0.2° and 28.2°±0.2° of the diffraction angle (2θ) in CuKα characteristic X-ray diffraction shows good results for sensitivity, residual potential and photomemory, but those having much superior characteristics with respect to charging performance and potential stability are being sought.

In order to improve characteristics, e.g., to broaden the sensitivity region, it is proposed to use a phthalocyanine compound and a azo pigment in combination. However, a difference in dispersibility between the phthalocyanine compound and the azo pigment requires a complicated dispersion method or results in an unstable dispersion in many cases. Also, from the viewpoint of achieving much higher process speed and much higher image quality, studies are being made on electrophotographic photosensitive members having much superior characteristics with respect to sensitivity, potential stability in repeated use, residual potential, black dots or fog due to faulty charging, and also memory to white light.

SUMMARY OF THE INVENTION

An object of the present invention is to provide an electrophotographic photosensitive member having a low residual potential, free of any faulty charging, showing a small photomemory, promising a high image quality and high sensitivity characteristics, and having stable potential characteristics when used repeatedly.

Another object of the present invention is to provide a process cartridge and an electrophotographic apparatus which employ such electrophotographic photosensitive member.

The present invention provides an electrophotographic photosensitive member comprising a support and a photosensitive layer provided on the support, the photosensitive layer containing an oxytitanium phthalocyanine having the strongest peak at 27.2°±0.2° of the diffraction angle (2θ) in CuKα characteristic X-ray diffraction and a hydroxygallium phthalocyanine having strong peaks at 7.4°±0.2° and 28.2°±0.2° of the diffraction angle (2θ) in CuKα characteristic X-ray diffraction.

The present invention also provides a process cartridge comprising the above electrophotographic photosensitive member of the present invention and a means selected from the group consisting of a charging means, a developing means and a cleaning means, which are supported as one unit and being detachably mountable to the main body of an electrophotographic apparatus.

The present invention still also provides an electrophotographic apparatus comprising the above electrophotographic photosensitive member of the present invention, a charging means, an exposure means, a developing means and a transfer means.

DESCRIPTION OF THE PREFERRED EMBODIMENTS

Figure 1:
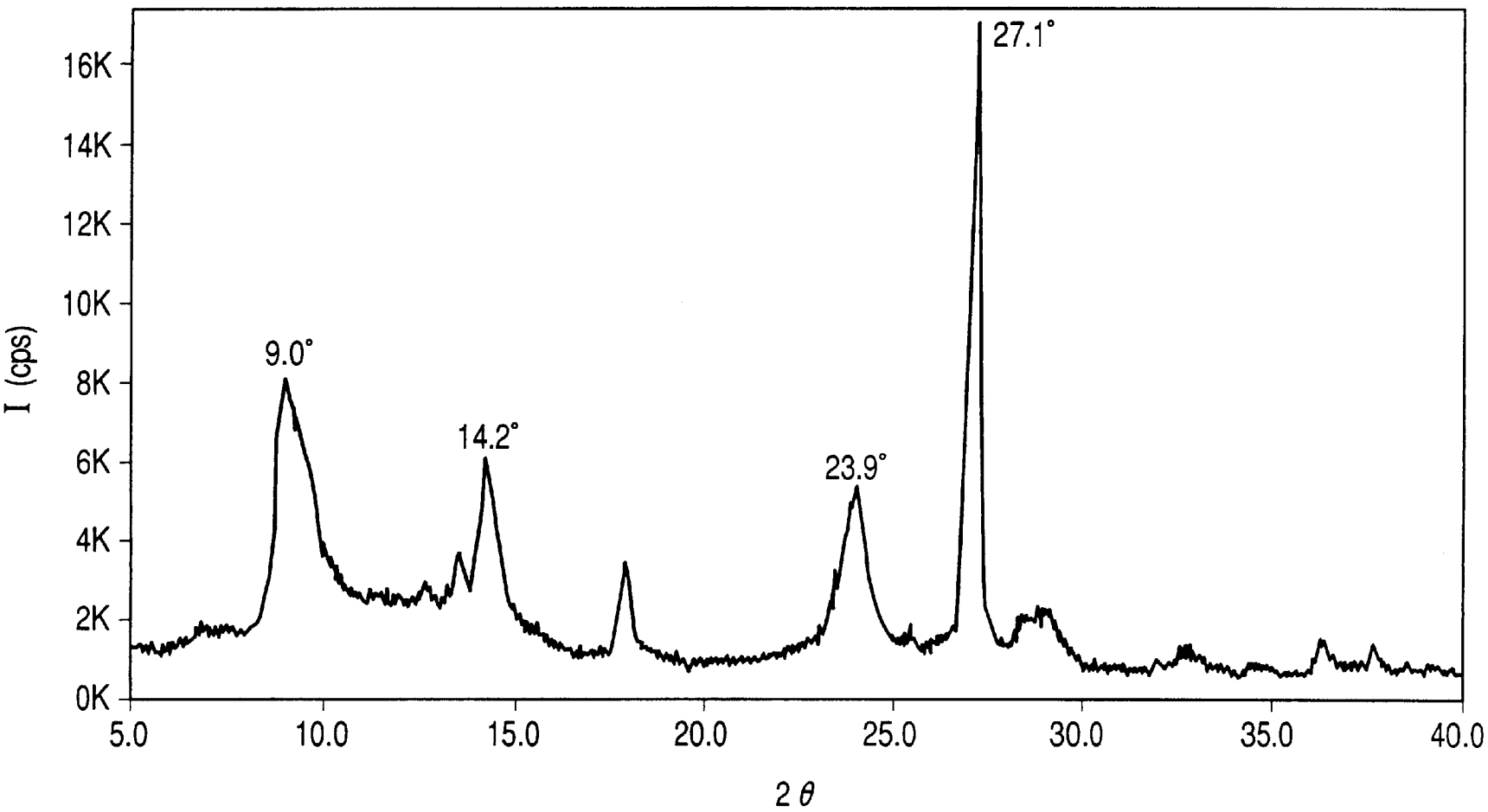
FIG. 1 shows an X-ray diffraction pattern of CuKα characteristics of oxytitanium phthalocyanine crystals obtained in Production Example 1.

The electrophotographic photosensitive member of the present invention has a photosensitive layer containing an oxytitanium phthalocyanine having the strongest peak at 27.2°±0.2° of the diffraction angle (2θ) in CuKα characteristic X-ray diffraction and a hydroxygallium phthalocyanine having strong peaks at 7.4°±0.2° and 28.2°±0.2° of the diffraction angle (2θ) in CuKα characteristic X-ray diffraction.

The oxytitanium phthalocyanine having the strongest peak at 27.2°±0.2° of the diffraction angle (2θ) in CuKα characteristic X-ray diffraction as used in the present invention may have a crystal form including, but not limited to, those having strong peaks at 9.0°, 14.2°, 23.9° and 27.1° of the diffraction angle (2θ±0.2°). those having strong peaks at 9.6° and 27.3° of the diffraction angle and those having strong peaks at 9.5°, 9.7°, 11.7°, 15.0°, 23.5°, 24.1° and 27.3° of the diffraction angle.

The hydroxygallium phthalocyanine having strong peaks at 7.4°±0.2° and 28.2°±0.2° of the diffraction angle (2θ) in CuKα characteristic X-ray diffraction may have a crystal form including, but not limited to, those having strong peaks at 7.3°, 24.9° and 28.1° of the diffraction angle (2θ±0.2°) and those having strong peaks at 7.5°, 9.9°, 16.3°, 18.6°, 25.1° and 28.3° of the diffraction angle (2θ±0.2°) as disclosed in Japanese Patent Application Laid-open No. 5-263007, etc.

The oxytitanium phthalocyanine used in the present invention is structurally represented by the following formula.

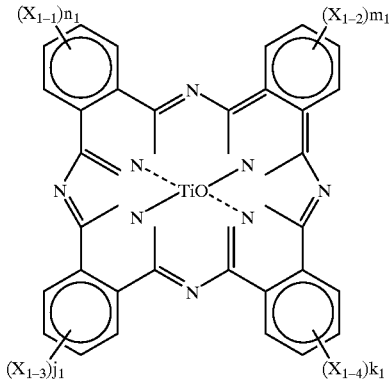

wherein $X_{1-1}$, $X_{1-2}$, $X_{1-3}$ and $X_{1-4}$ each represent Cl or Br; and $n_1$, $m_1$, $k_1$ and $j_1$ each represent an integer of 0 to 4.

The hydroxygallium phthalocyanine used in the present invention is structurally represented by the following formula.

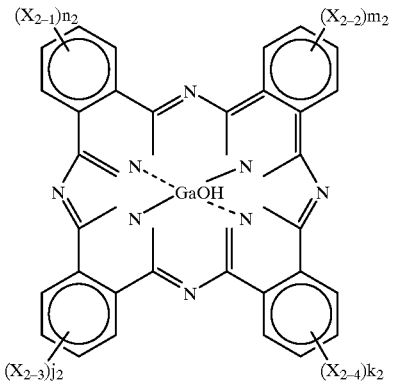

wherein $X_{2-1}$, $X_{2-2}$, $X_{2-3}$ and $X_{2-4}$ each represent Cl or Br; and $n_2$, $m_2$, $k_2$ and $j_2$ each represent an integer of 0 to 4.

In the present invention, the oxytitanium phthalocyanine and the hydroxygallium phthalocyanine may preferably be contained in a ratio of from 9:1 to 1:59 in weight ratio. If the oxytitanium phthalocyanine is in a too large proportion, unsatisfactory residual potential, photomemory and potential stability tend to result. If it is in a too small proportion, faulty images such as black spots and fog due to faulty charging tend to occur and also an unsatisfactory potential stability tends to result.

In the electrophotographic photosensitive member of the present invention, the photosensitive layer may be of any configuration, including a multi-layer type having a charge generation layer containing a charge-generating material and a charge transport layer containing a charge-transporting material, and a single-layer type containing both the charge-generating material and the charge-transporting material in the same layer.

In the case of the former, there are two ways of superposing the layers. In particular, a configuration wherein the charge generation layer and the charge transport layer are superposed in this order from the support side is preferred in view of electrophotographic performance.

The charge generation layer contains the oxytitanium phthalocyanine and hydroxygallium phthalocyanine as charge-generating materials, and a binder resin. When the charge-generating materials are mixed, the materials may be dispersed in a ratio within the above range in suitable binder resin and solvent, or their dispersions individually prepared may be mixed in a prescribed ratio or superposed in layers. When dispersions are individually prepared, binder resins and solvents may respectively differ from each other. When superposed in layers, the dispersions individually prepared may be coated in such a way that the materials contained are in a prescribed weight ratio.

The binder resin used may include polyesters, acrylic resins, polyvinyl carbazole, phenoxy resins, polycarbonate, polyvinyl butyral, polyvinyl benzal, polystyrene, polyvinyl acetate, polysulfone, polyarylates, and vinylidene chloride-acrylonitrile copolymer.

The charge transport layer is formed by coating a coating solution prepared by chiefly dissolving a charge-transporting material and a binder resin in a solvent, and drying the wet coating formed. The charge-transporting material used may include various types of triarylamine compounds, hydrazone compounds, stilbene compounds, pyrazoline compounds, oxazole compounds, thiazole compounds and triarylmethane compounds. As the binder resin, the same resins as those for the charge generation layer may be used.

In the case of the photosensitive layer of single-layer type, it can be formed by coating a coating fluid containing the charge-generating material, the charge-transporting material and the binder resin, followed by drying.

The support may be any of those having a conductivity and may include metals such as aluminum and stainless steel, and metals, plastics or papers provided with conductive layers. The support may be in the form of a cylinder or a film.

A subbing layer having a barrier function and an adhesion function may be provided between the support and the photosensitive layer. Materials for the subbing layer may include polyvinyl alcohol, polyethylene oxide, ethyl cellulose, methyl cellulose, casein, polyamide, glue and gelatin. These are each dissolved in a suitable solvent, followed by coating on the support.

Between the support and the subbing layer, a conductive layer may also be provided so that any unevenness or defects on the support can be covered and interference fringes due to light scattering can be prevented when images are inputted using laser light. This layer may be formed by dispersing a conductive powder such as carbon black, metal particles or metal oxide in the binder resin. The conductive layer may preferably have a layer thickness of from 5 to 40 $\mu$m, and particularly preferably from 10 to 30 $\mu$m.

These layers may be coated by a method including dip coating, spray coating, spin coating, bead coating, blade coating and beam coating.

The electrophotographic photosensitive member of the present invention can be not only utilized in electrophotographic copying machines, but also widely used in the field in which the electrophotography is applied as exemplified by laser beam printers, CRT printers, LED printers, liquid-crystal printers, laser beam engravers and facsimile machines.

The process cartridge and electrophotographic apparatus of the present invention are described below.

Figure 4:
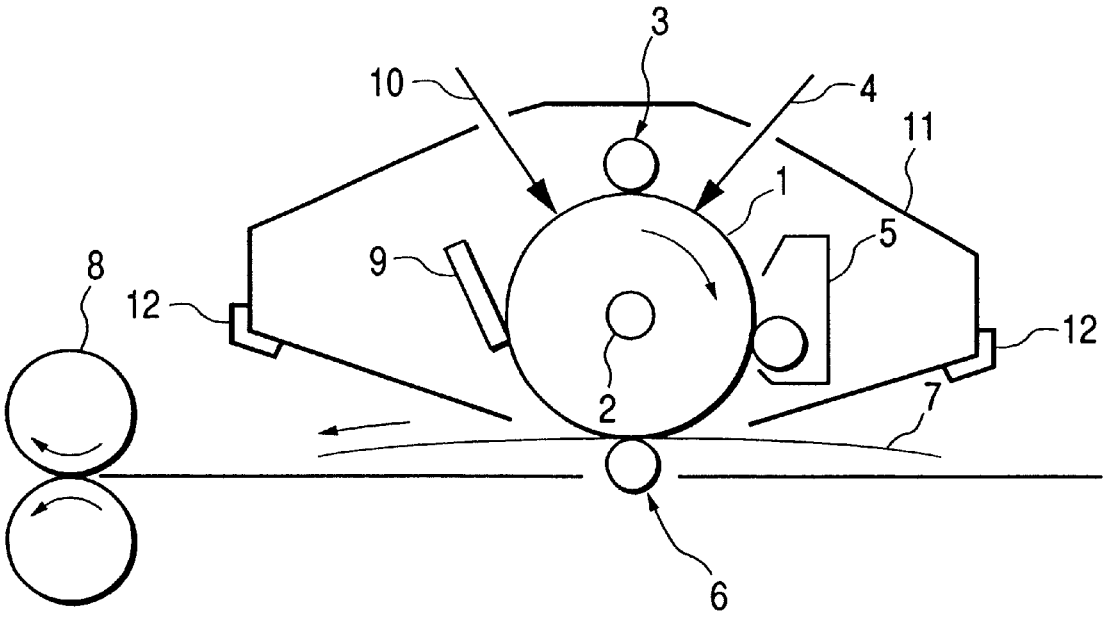
FIG. 4 schematically illustrates the construction of an electrophotographic apparatus having a process cartridge having the electrophotographic photosensitive member of the present invention.

FIG. 4 schematically illustrates the construction of an electrophotographic apparatus having a process cartridge having the electrophotographic photosensitive member of the present invention.

In FIG. 4, reference numeral 1 denotes an electrophotographic photosensitive member of the present invention, which is rotatingly driven around an axis 2 in the direction of an arrow at a given peripheral speed. In the course of its rotation, the photosensitive member 1 is uniformly electrostatically charged on its periphery to a positive or negative, given potential through a primary charging means 3. The photosensitive member thus charged is then exposed to light 4 emitted from an exposure means (not shown) for slit exposure or laser beam scanning exposure. In this way, electrostatic latent images are successively formed on the periphery of the photosensitive member 1.

The electrostatic latent images thus formed are subsequently developed by toner by the operation of a developing means 5. The resulting toner-developed images are then successively transferred by the operation of a transfer means 6, to the surface of a transfer medium 7 fed from a paper feed section (not shown) to the part between the photosensitive member 1 and the transfer means 6 in the manner synchronized with the rotation of the photosensitive member 1.

The transfer medium 7 to which the images have been transferred is separated from the surface of the photosensitive member, is led to an image fixing means 8, where the images are fixed, and is then printed out of the apparatus as a copied material (a copy).

The surface of the photosensitive member 1 after the transfer of images is brought to removal of the toner remaining after the transfer, through a cleaning means 9. Thus, the photosensitive member is cleaned on its surface, further subjected to charge elimination by pre-exposure light 10 emitted from a pre-exposure means (not shown), and then repeatedly used for the formation of images. In the apparatus shown in FIG. 4, since the primary charging means 3 is a contact charging means making use of a charging roller, the pre-exposure is not necessarily required.

In the present invention, the apparatus may be constituted of plural components integrally supported as a process cartridge from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, at least one of the primary charging means 3, the developing means 5 and the cleaning means 9 may integrally be supported in a cartridge together with the electrophotographic photosensitive member 1 to form a process cartridge 11 that is detachably mountable to the body of the apparatus through a guide means such as a rail 12 provided in the body of the apparatus.

In the case when the electrophotographic apparatus is used as a copying machine or a printer, the exposure light 4 is light reflected from, or transmitted through, an original, or light irradiated by the scanning of a laser beam, the driving of an LED array or the driving of a liquid crystal shutter array according to signals obtained by reading an original and converting the information into signals.

Production examples for the phthalocyanine compounds used in the present invention are given below.

Production Example 1

(Production of oxytitanium phthalocyanine)

In 100 g of $\alpha$-chloronaphthalene, 5.0 g of o-phthalodinitrile and 2.0 g of titanium tetrachloride were stirred at 200° C. for 3 hours, followed by cooling to 50° C. The crystals precipitated were filtered to obtain a paste of dichlorotitanium phthalocyanine. Next, with stirring, this paste was washed with 100 ml of N,N-dimethylformamide heated to 100° C., and then repeatedly washed twice with 100 ml of 60° C. methanol to effect filtration. The paste thus obtained was further stirred in 100 ml of deionized water at 80° C. for 1 hour, followed by filtration to obtain blue oxytitanium phthalocyanine crystals. Yield: 4.3 g. Values of elemental analysis ($C_{32}H_{16}N_8TiO$)

| | C | H | N | Cl |
|---|---|---|---|---|
| Calculated (%): | 66.68 | 2.80 | 19.44 | — |
| Found (%): | 66.50 | 2.99 | 19.42 | 0.47 |

Next, the crystals obtained were dissolved in 30 ml of concentrated sulfuric acid, and the solution obtained was added dropwise in 300 ml of 20° C. deionized water with stirring to effect re-precipitation, followed by filtration. The filtrate obtained was thoroughly washed with water to obtain noncrystalline oxytitanium phthalocyanine. Then, 4.0 g of the noncrystalline oxytitanium phthalocyanine thus obtained was treated by suspending and stirring it in 100 ml of methanol at room temperature (22° C.) for 8 hours, followed by filtration and then drying under reduced pressure to obtain low-crystalline oxytitanium phthalocyanine. Next, to 2.0 g of this oxytitanium phthalocyanine, 40 ml of n-butyl ether was added, and treated by milling at room temperature (22° C.) for 20 hours using glass beads of 1 mm diameter.

From the resultant dispersion, solid matter was taken out, and thoroughly washed with methanol and then with water, followed by drying to obtain oxytitanium phthalocyanine. Yield: 1.8 g.

This oxytitanium phthalocyanine had strong peaks at 9.0°, 14.2°, 23.9° and 27.1° of the diffraction angle (2θ±0.2°) in CuKα characteristic X-ray diffraction. The X-ray diffraction pattern of this crystals is shown in FIG. 1.

Production Example 2

(Production of hydroxygallium phthalocyanine)

73 g of o-phthalodinitrile, 25 g of gallium trichloride and 400 ml of α-chloronaphthalene were allowed to react at 200° C. for 4 hours in an atmosphere of nitrogen, and thereafter the product was filtered at 130° C. The resultant product was dispersed and washed at 130° C. for 1 hour using N,N-dimethylformamide, followed by filtration and then washing with methanol, further followed by drying to obtain 45 g of chlorogallium phthalocyanine. Elemental analysis of this compound revealed the following. Values of elemental analysis ($C_{32}H_{16}N_8ClGa$)

| | C | H | N | Cl |
|---|---|---|---|---|
| Calculated (%): | 62.22 | 2.61 | 18.14 | 5.74 |
| Found (%): | 61.78 | 2.66 | 18.28 | 6.25 |

15 g of the chlorogallium phthalocyanine obtained here was dissolved in 450 g of 5° C. concentrated sulfuric acid, and the solution obtained was added dropwise in 2,300 g of ice water with stirring to effect re-precipitation, followed by filtration. The filtrate obtained was dispersed and washed with 2% aqueous ammonia, and then thoroughly washed with ion-exchanged water, followed by freeze-drying at a degree of vacuum of 1 mmHg by means of a freeze dryer to obtain 13 g of low-crystalline hydroxygallium phthalocyanine.

Figure 2:
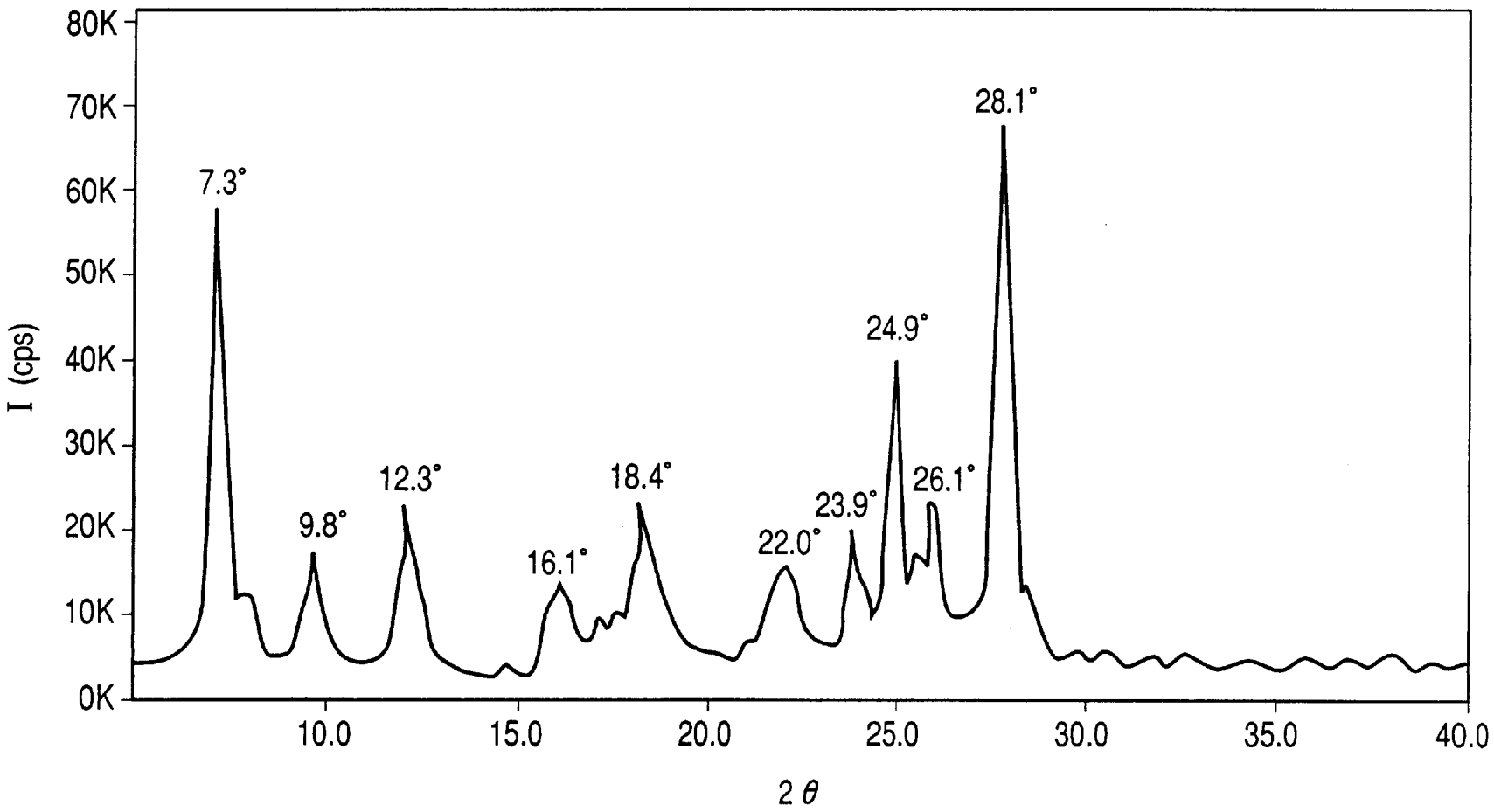
FIG. 2 shows an X-ray diffraction pattern of CuKα characteristics of chlorogallium phthalocyanine crystals obtained in Production Example 2.

Next, 7 g of the hydroxygallium phthalocyanine thus obtained and 210 g of N,N'-dimethylformamide were treated by milling with a sand mill at room temperature (22° C.) for 5 hours using 300 g of glass beads of 1 mm diameter. From the resultant dispersion, solid matter was taken out and then thoroughly washed with methanol, followed by drying to obtain 5.6 g of hydroxygallium phthalocyanine. This hydroxygallium phthalocyanine had strong peaks at 7.3°, 24.9° and 28.1° of the diffraction angle (2θ±0.2°) in CuKα characteristic X-ray diffraction. The X-ray diffraction pattern of this crystals is shown in FIG. 2. Also, elemental analysis of this compound revealed the following. Values of elemental analysis ($C_{32}H_{17}N_8OGa$)

| | C | H | N | Cl |
|---|---|---|---|---|
| Calculated (%): | 64.14 | 2.86 | 18.70 | — |
| Found (%): | 62.75 | 2.56 | 18.31 | 0.54 |

Production Example 3

(Production of oxytitanium phthalocyanine)

Figure 3:
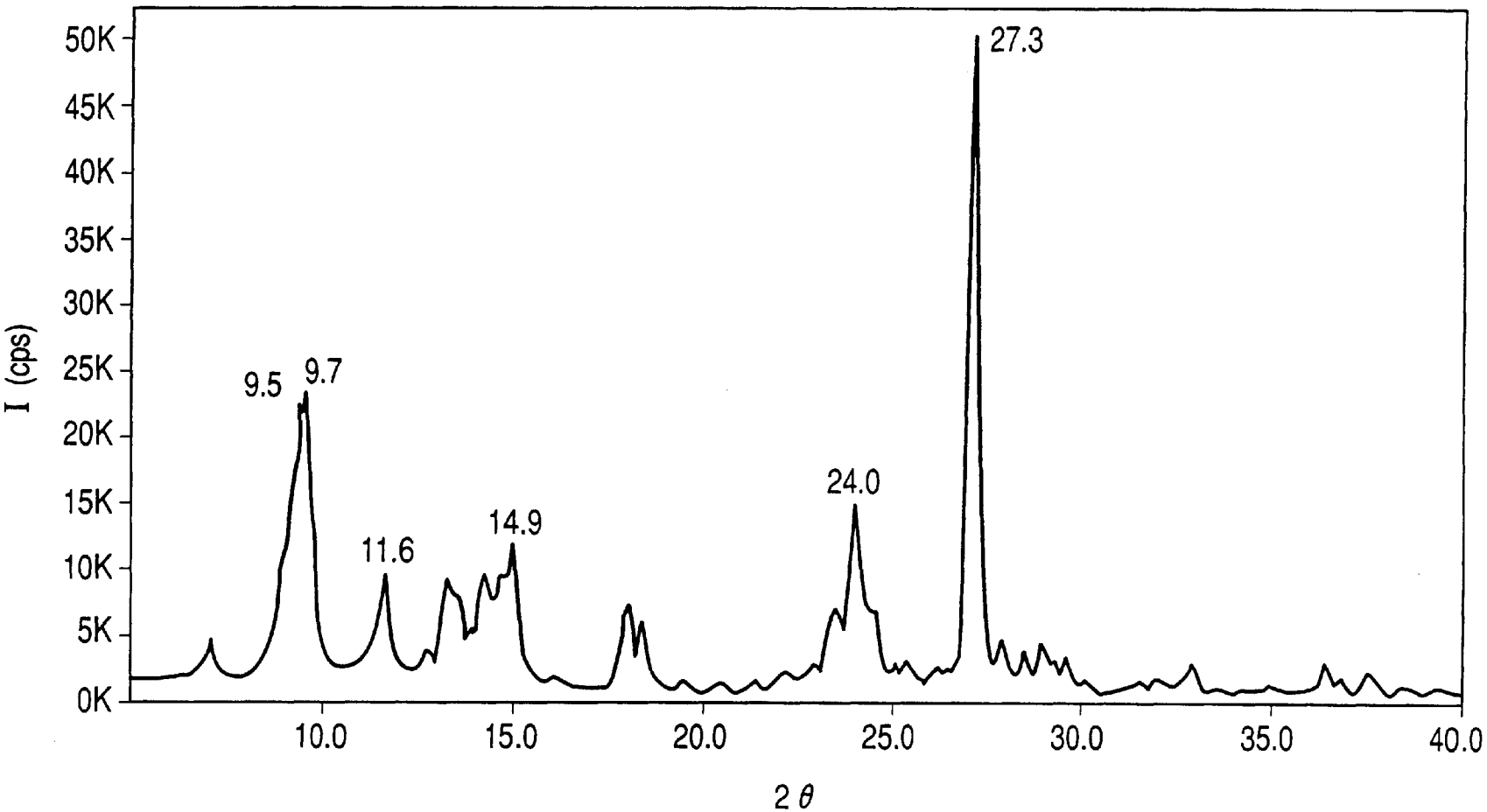
FIG. 3 shows an X-ray diffraction pattern of CuKα characteristics of oxytitanium phthalocyanine crystals obtained in Production Example 3.

Production Example disclosed in Japanese Patent Application Laid-open No. 64-17066 was carried out to obtain crystalline oxytitanium phthalocyanine having strong peaks at 9.5°, 9.7°, 11.6°, 14.9°, 24.0° and 27.3° of the diffraction angle (2θ±0.2°) in CuKα characteristic X-ray diffraction. The X-ray diffraction pattern of this crystals is shown in FIG. 3.

The present invention will be described below by giving Examples.

EXAMPLE 1

50 parts (parts by weight; the same applies hereinafter) of titanium oxide powder coated with tin oxide, containing 10% of antimony oxide, 25 parts of resol type phenol resin, 20 parts of methyl cellosolve, 5 parts of methanol and 0.02 part of silicone oil (polydimethylsiloxane-polyoxyalkylene copolymer; average molecular weight: 30,000) were dispersed for 2 hours by means of a sand mill making use of glass beads of 1 mm diameter to prepare a conductive coating fluid. This coating fluid was dip-coated on an aluminum cylinder, followed by drying at 140° C. for 30 minutes to form a conductive layer with a layer thickness of 20 μm.

On this conductive layer, a solution prepared by dissolving 5 parts of a 6-66-610-12 polyamide quadripolymer in a mixed solvent of 70 parts of methanol and 25 parts of butanol was dip-coated, followed by drying to form a subbing layer with a layer thickness of 1 μm.

Next, to a solution prepared by dissolving 4 parts of polyvinyl butyral (trade name: S-LEC BX-1; available from Sekisui Chemical Co., Ltd.) in 100 parts of cyclohexanone, 7.2 parts of the oxytitanium phthalocyanine crystal obtained in Production Example 1 and 0.8 part of the hydroxygallium phthalocyanine crystal obtained in Production Example 2 were added. The mixture obtained was dispersed for 2 hours by means of a sand mill making use of glass beads of 1 mm diameter. To the dispersion thus obtained, 100 parts of ethyl acetate was added to dilute it. Thereafter, the resultant dispersion was dip-coated on the subbing layer, followed by drying at 100° C. for 10 minutes to form a charge generation layer with a layer thickness of 0.18 μm.

Next, 10 parts of a charge-transporting material represented by the following structural formula:

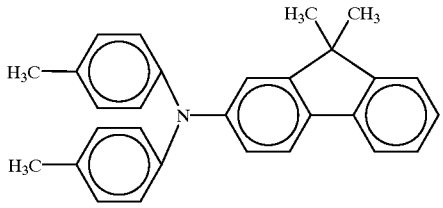

and 10 parts of bisphenol-Z polycarbonate were dissolved in 60 parts of monochlorobenzene to prepare a solution, which was then dip-coated on the charge generation layer, followed by drying at 100° C. for 1 hour to form a charge transport layer with a layer thickness of 23 μm, thus an electrophotographic photosensitive member was produced.

The electrophotographic photosensitive member thus produced was set in a modified machine of a digital copying machine (trade name: GP-55; manufacture by CANON INC.). Its surface was so set as to have a dark-area potential of −700V, and was exposed to laser light of 780 nm, where the amount of light necessary for the potential of −700 V to attenuate to −150 V was measured to examine the sensitivity.

The potential when exposed to light with energy of 20 $\mu J/cm^2$ was also measured as residual potential Vr. Results obtained were as shown below. Sensitivity: 0.17 ($\mu J/cm^2$) Residual potential Vr: −15 V Next, in three environments of 15° C./10% RH, 18° C./50% RH and 35° C./80% RH, the initial dark-area potential was set at −700 V, and the initial light-area potential at −150 V, where a running test was made on 3,000 sheets continuously. After running, the dark-area potential and light-area potential were measured, and image quality was evaluated by visual observation. As a result, in all environments, potential characteristics and image quality as good as those at the initial stage were maintained after the running.

EXAMPLE 2

An electrophotographic photosensitive member was produced in the same manner as in Example 1 except that 7.2 parts of the oxytitanium phthalocyanine crystal obtained in Production Example 1 and 0.8 part of the hydroxygallium phthalocyanine crystal obtained in Production Example 2 were replaced with 6.4 parts of the former and 1.6 parts of the latter.

EXAMPLE 3

An electrophotographic photosensitive member was produced in the same manner as in Example 1 except that 7.2 parts of the oxytitanium phthalocyanine crystal obtained in Production Example 1 and 0.8 part of the hydroxygallium phthalocyanine crystal obtained in Production Example 2 were replaced with 4 parts of the former and 4 parts of the latter.

EXAMPLE 4

An electrophotographic photosensitive member was produced in the same manner as in Example 1 except that 7.2 parts of the oxytitanium phthalocyanine crystal obtained in Production Example 1 and 0.8 part of the hydroxygallium phthalocyanine crystal obtained in Production Example 2 were replaced with 1.6 parts of the former and 6.4 parts of the latter.

REFERENCE EXAMPLE 5

An electrophotographic photosensitive member was produced in the same manner as in Example 1 except that 7.2 parts of the oxytitanium phthalocyanine crystal obtained in Production Example 1 and 0.8 part of the hydroxygallium phthalocyanine crystal obtained in Production Example 2 were replaced with 6.4 parts of the oxytitanium phthalocyanine crystal obtained in Production Example 3 and 1.6 parts of the hydroxygallium phthalocyanine crystal obtained in Production Example 2.

Comparative Example 1

An electrophotographic photosensitive member was produced in the same manner as in Example 1 except that 7.2 parts of the oxytitanium phthalocyanine crystal obtained in Production Example 1 and 0.8 part of the hydroxygallium phthalocyanine crystal obtained in Production Example 2 were replaced with 8 parts of the former only.

Comparative Example 2

An electrophotographic photosensitive member was produced in the same manner as in Example 1 except that 7.2 parts of the oxytitanium phthalocyanine crystal obtained in Production Example 1 and 0.8 part of the hydroxygallium phthalocyanine crystal obtained in Production Example 2 were replaced with 8 parts of the latter only.

Comparative Example 3

An electrophotographic photosensitive member was produced in the same manner as in Example 1 except that 7.2 parts of the oxytitanium phthalocyanine crystal obtained in Production Example 1 and 0.8 part of the hydroxygallium phthalocyanine crystal obtained in Production Example 2 were replaced with 8 parts of the oxytitanium phthalocyanine crystal obtained in Production Example 3.

Comparative Example 4

An electrophotographic photosensitive member was produced in the same manner as in Example 1 except that 7.2 parts of the oxytitanium phthalocyanine crystal obtained in Production Example 1 and 0.8 part of the hydroxygallium phthalocyanine crystal obtained in Production Example 2 were replaced with 4 parts of the oxytitanium phthalocyanine crystal obtained in Production Example 3 and 4 parts of a diazo pigment represented by the following structural formula.

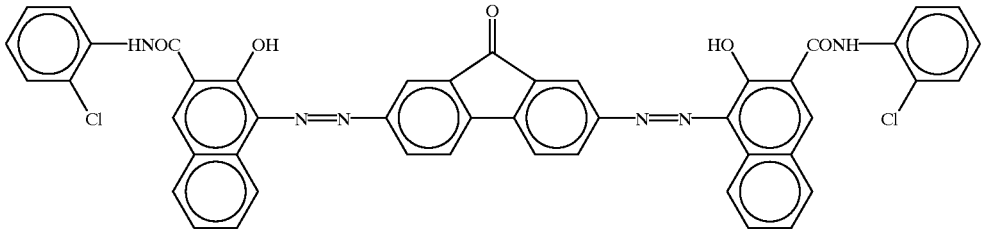

On these electrophotographic photosensitive members, their sensitivity and residual potential Vr were measured in the same manner as in Example 1. Results obtained are shown in Table 1.

TABLE 1

| | Sensitivity ($\mu J/cm^2$) | Vr (−V) |
|---|---|---|
| Example: | | |
| 2 | 0.18 | 15 |
| 3 | 0.21 | 15 |
| 4 | 0.26 | 10 |
| 5 | 0.21 | 15 |

TABLE 1-continued

| | Sensitivity ($\mu J/cm^2$) | Vr (−V) |
|---|---|---|
| Comparative Example: | | |
| 1 | 0.20 | 35 |
| 2 | 0.27 | 20 |
| 3 | 0.23 | 30 |
| 4 | 0.22 | 20 |

Setting the initial dark-area potential at −700 V and the initial light-area potential at −150 V, a running test was made on 3,000 sheets continuously, and the amount of changes in dark-area potential and light-area potential between those at the initial stage and those after 3,000-sheet running, ΔVd and ΔV1, were measured. In the table, the plus signs in the data of the amount of changes indicate an increase in absolute value of potential, and the minus signs a decrease in absolute value of potential. Evaluation was also made on black dots and fog by visual observation after running.

Results obtained are shown in Table 2.

TABLE 2

| | Evaluation on black dots and fog | ΔVd (V) | ΔVl (V) |
|---|---|---|---|
| Example: | | | |
| 2 | good | −5 | 0 |
| 3 | good | −5 | +5 |
| 4 | good | +5 | +15 |
| 5 | good | −10 | −5 |
| Comparative Example: | | | |
| 1 | good | −30 | −10 |
| 2 | poor | +10 | +40 |
| 3 | good | −50 | −25 |
| 4 | poor | −40 | +20 |

EXAMPLES 6 to 9 and Reference Example 10

The electrophotographic photosensitive members corresponding to those produced in Examples 1 to 5 and Comparative Examples 1 to 4, respectively, were exposed to light of 1,500 lux for 5 minutes using a white fluorescent light, and differences between dark-area potential after exposure for 2 minutes and dark-area potential before exposure, $\Delta V_{PM}$, were measured to make evaluation of photomemory.

Results obtained are shown in Table 3.

TABLE 3

| | $\Delta V_{PM}$ |
|---|---|
| Example: | |
| 6 | 40 |
| 7 | 35 |
| 8 | 20 |
| 9 | 15 |
| Reference Example 10 | 50 |
| Comparative Example: | |
| 5 | 100 |
| 6 | 30 |
| 7 | 130 |
| 8 | 110 |

As can be seen from the above results, the electrophotographic photosensitive members of the present invention show a low residual potential, are free from faulty images such as black spots and fog, show a small photomemory, and have high sensitivity characteristics and stable potential characteristics in their repeated use.

What is claimed is:

1. An electrophotographic photosensitive member comprising a support and a photosensitive layer provided on the support, said photosensitive layer containing an oxytitanium phthalocyanine having the strongest peak at 27.2°±0.2° of the diffraction angle (2θ) in CuKα characteristic X-ray diffraction and a hydroxygallium phthalocyanine having strong peaks at 7.4°±0.2° and 28.2°±0.2° of the diffraction angle (2θ) in CuKα characteristic X-ray diffraction, wherein said oxytitanium phthalocyanine has strong peaks at 9.0°, 14.2°, 23.9°, and 27.1° of the diffraction angle (2θ±0.2°) in CuKα characteristic X-ray diffraction.

2. The electrophotographic photosensitive member according to claim 1, wherein said hydroxygallium phthalocyanine has strong peaks at 7.3° and 24.9° and the strongest peak at 28.1° of the diffraction angle (2θ±0.2°) in CuKα characteristic X-ray diffraction.

3. The electrophotographic photosensitive member according to claim 1, wherein said hydroxygallium phthalocyanine has the strongest peak at 7.5°, and strong peaks at 9.9°, 16.3°, 18.6°, 25.1° and 28.3° of the diffraction angle (2θ±0.2°) in CuKα characteristic X-ray diffraction.

4. The electrophotographic photosensitive member according to claim 1, wherein said photosensitive layer comprises a charge generation layer and a charge transport layer, and the charge generation layer contains said oxytitanium phthalocyanine and said hydroxygallium phthalocyanine.

5. A process cartridge comprising an electrophotographic photosensitive member and a means selected from the group consisting of a charging means, a developing means and a cleaning means;

said electrophotographic photosensitive member and at least one of said means being supported as one unit and being detachably mountable to the main body of an electrophotographic apparatus; and said electrophotographic photosensitive member comprising a support and a photosensitive layer provided on the support, said photosensitive layer containing an oxytitanium phthalocyanine having the strongest peak at 27.2°±0.2° of the diffraction angle (2θ) in CuKα characteristic X-ray diffraction and a hydroxygallium phthalocyanine having strong peaks at 7.4°±0.2° and 28.2°±0.2° of the diffraction angle (2θ) in CuKα characteristic X-ray diffraction, wherein said oxytitanium phthalocyanine has strong peaks at 9.0°, 14.2°, 23.9° and 27.1° of the diffraction angle (2θ±0.2°) in CuKα characteristic X-ray diffraction.

6. An electrophotographic apparatus comprising an electrophotographic photosensitive member, a charging means, an exposure means, a developing means and a transfer means; and said electrophotographic photosensitive member comprising a support and a photosensitive layer provided on the support, said photosensitive layer containing an oxytitanium phthalocyanine having the strongest peak at 27.2°±0.2° of the diffraction angle (2θ) in CuKα characteristic X-ray diffraction and a hydroxygallium phthalocyanine having strong peaks at 7.4°±0.2° and 28.2°±0.2° of the diffraction angle (2θ) in CuKα characteristic X-ray diffraction, wherein said oxytitanium phthalocyanine has strong peaks at 9.0°, 14.2°, 23.9° and 27.1° of the diffraction angle (2θ±0.2°) in CuKα characteristic X-ray diffraction.

* * * * *

UNITED STATES PATENT AND TRADEMARK OFFICE

CERTIFICATE OF CORRECTION

PATENT NO. : 6,270,936 B1
DATED : August 7, 2001
INVENTOR(S) : Masato Tanaka et al.

It is certified that error appears in the above-identified patent and that said Letters Patent is hereby corrected as shown below:

Column 2,
Line 3, "a" should read -- an --; and
Line 53, "chlorogallium" should read -- hydroxygallium --.

Column 3,
Line 15, "(2θ±0.2°)." should read -- (2θ±0.2°), --.

Column 7,
Line 14, "this" should read -- these --; and
Line 57, "this" should read -- these --.

Column 8,
Line 8, "this" should read -- these --; and
Line 63, "manufacture" should read -- manufactured --.

Column 11,
Line 40, "9 and Reference Example 10" should read -- 9, Reference Example 10, and Comparative Examples 5 to 8 --.

Signed and Sealed this

Sixteenth Day of April, 2002

*Attest:*

*Attesting Officer*

JAMES E. ROGAN
*Director of the United States Patent and Trademark Office*